United States Patent [19]

Maezawa

[11] 4,148,180

[45] Apr. 10, 1979

[54] ELECTRONIC TIMEPIECE CIRCUIT FOR AUTOMATICALLY DISPLAYING THE DAY OF THE WEEK

[75] Inventor: Shuji Maezawa, Suwa, Japan

[73] Assignee: Kabushiki Kaisha Suwa Seikosha, Tokyo, Japan

[21] Appl. No.: 796,112

[22] Filed: May 11, 1977

[30] Foreign Application Priority Data

May 11, 1976 [JP] Japan ..... 51-53706

[51] Int. Cl.[2] ..... G04B 19/24; G04C 3/00

[52] U.S. Cl. ..... 58/4 A; 58/58

[58] Field of Search ..... 58/4 A, 23 R, 50 R, 58/58

[56] References Cited

U.S. PATENT DOCUMENTS

| | | | |
|---|---|---|---|
| 3,852,950 | 12/1974 | Yoda et al. | 58/4 A |
| 3,889,458 | 6/1975 | Kashio | 58/4 A |
| 3,978,296 | 8/1976 | Moriya et al. | 58/4 A X |
| 3,982,387 | 9/1976 | Tanaka | 58/4 A X |
| 4,040,245 | 8/1977 | Chetelat | 58/4 A |

*Primary Examiner*—Stanley J. Witkowski

*Attorney, Agent, or Firm*—Blum, Moscovitz, Friedman & Kaplan

[57] ABSTRACT

An electronic timepiece circuit for automatically changing the day of the week by utilizing the timekeeping signals produced by the day counter, month counter and year counter is provided. Remainder circuitry is coupled to the respective day, minute and year counters and is adapted to sum bit signals representative of the binary count of the respective day, month and year counters and divide the summed bit signals by a count of seven and thereby produce a remainder signal. The remainder signal is applied to appropriate decoding and display circuitry to effect a display of the day of the week in response to the remainder signal applied thereto.

9 Claims, 2 Drawing Figures

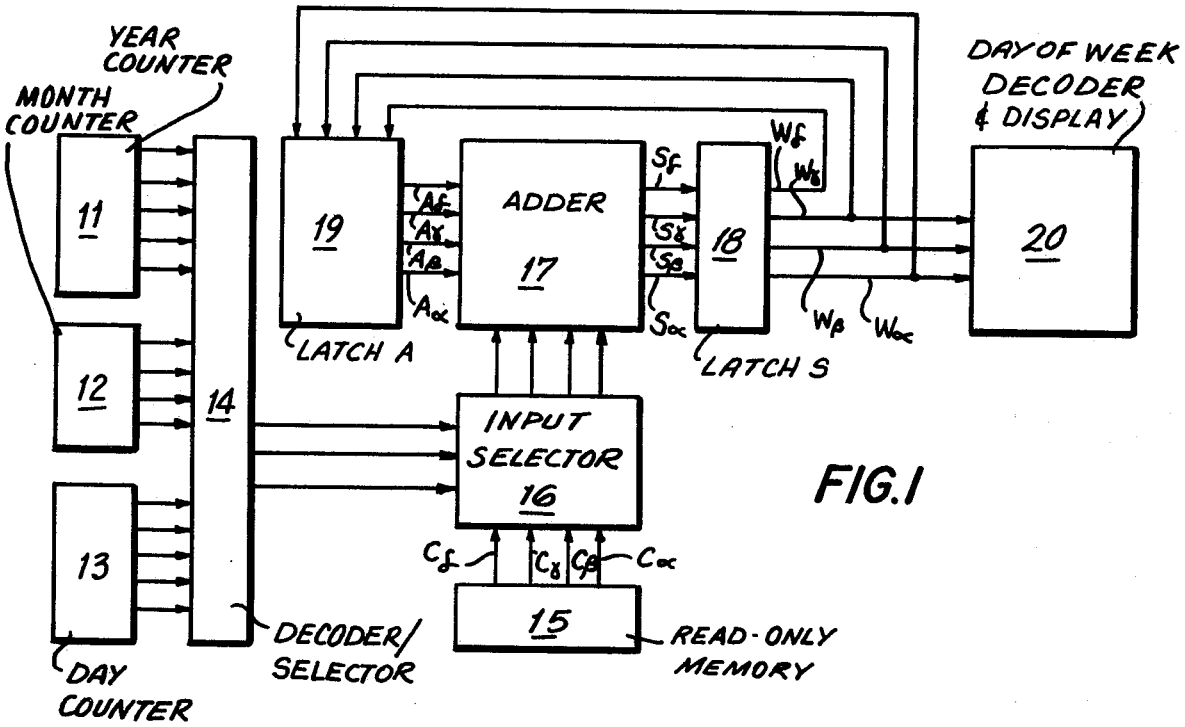
FIG.1
FIG.2
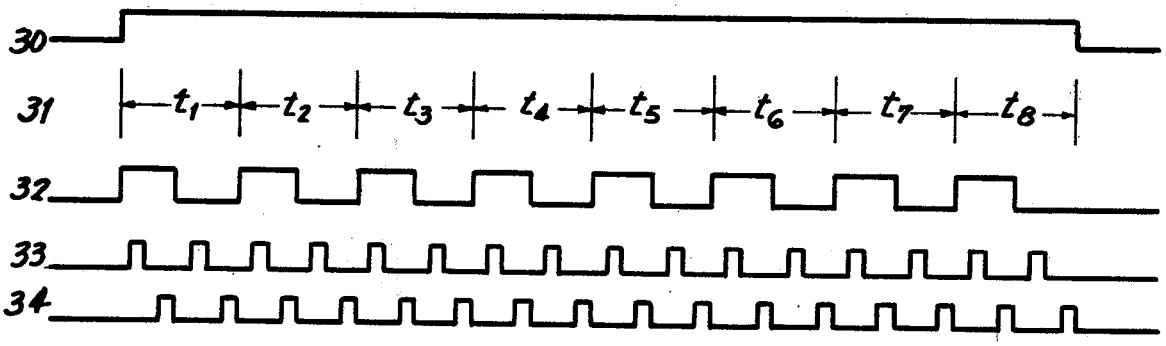

ELECTRONIC TIMEPIECE CIRCUIT FOR AUTOMATICALLY DISPLAYING THE DAY OF THE WEEK

BACKGROUND OF THE INVENTION

This invention is directed to electronic timepiece circuitry for automatically displaying the day of the week, and in particular, to electronic timepiece circuitry for decoding the timekeeping signals produced by the day, date and year counters of an electronic timepiece into bit signals, summing the bit signals, dividing same by a count of seven, and utilizing the remainder to automatically effect a display of the day of the week.

Heretofore, in electronic timepieces having calendar displays of the type wherein the day, date and month information are displayed, when the day of the week is also displayed, the electronic circuitry utilized to select the day of the week is operated independently of the other calendar circuitry, in particular, the day, month and year counters. It is noted however that the day of the week can be derived from the timekeeping signals produced by the year counter, month counter and day counter, and accordingly, an electronic timepiece circuit, capable of automatically displaying the day of the week in response to the timekeeping signals produced by the day, month and year counters, is desired.

SUMMARY OF THE INVENTION

Generally speaking, in accordance with the instant invention, an electronic timepiece circuit for automatically displaying the day of the week, in response to the timekeeping signal respectively produced by a day counter, month counter and year counter, is provided. Each of the timekeeping signals produced by the respective counters is representative of a binary count thereof. The electronic circuitry of the instant invention is particularly characterized by decoder and selection circuitry coupled to each of the counters for receiving the timekeeping signals produced thereby, decoding same and seriatim producing a plurality of binary bit signals, each of which are representative of a binary count of the selected and decoded timekeeping signals. Remainder circuitry is provided for receiving and summing each of the binary bit signals, dividing the summed signals by seven to thereby produce a remainder signal representative of the day of the week. A day of the week decoder circuit and display is provided for decoding the remainder signal and displaying the day of the week in response to the remainder signal being applied thereto.

Accordingly, it is an object of the instant invention to provide an improved electronic timepiece circuit for automatically displaying the day of the week.

A further object of the instant invention is to provide an electronic timepiece circuit that utilizes the count of the timekeeping signals produced by the day, month and year counters to automatically effect a display of the day of the week.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a block circuit of an electronic timepiece circuit for automatically displaying the day of the week constructed in accordance with the preferred embodiment of the instant invention; and FIG. 2 is a wave diagram illustrating the operation of the electronic timepiece circuitry depicted in FIG. 1.

DETAILED DESCRIPTION OF THE PREFERRED EMBODIMENTS

Reference is first made to FIG. 1, wherein an electronic timepiece circuit for automatically displaying the day of the week is depicted. A decoder/selector circuit 14 is coupled to day counter 13, month counter 12 and year counter 11 to respectively receive the 5-bit, 4-bit and 5-bit timekeeping signals produced thereby. The decoder/selector circuit 14 is adapted in response to receiving the timekeeping signals produced by the day counter, month counter and year counter to produce seven distinct 3-bit output signals, and to apply the seven 3-bit output signals seriatim to an input selector 16. A read only memory 15, having the binary equivalent of the number minus seven stored therein, is also coupled to the input selector 16 at the inputs $C_\alpha$, $C_\gamma$, $C_\beta$, $C_\alpha$ of the input selector 16. The binary equivalent of the number -7 (1001) is used because only four bits of information are stored in the read-only memory and read into input selector 16. Thus, the fifth binary bit of information is ignored. Accordingly, the number -7 is selected so that the fourth bit does not become 0 when a binary 8 (1000) is summed with any binary number from 8 to 15 which would normally cause the fourth bit to be changed to a binary 0 and the fifth bit indexed to a binary 1. Specifically, the input selector 16 alternately applies the bit signals and, thereafter, the minus seven binary count stored in the read only memory 15 to the adder 17 to permit the binary count of the bit signal to be divided by seven by the 4-bit adder circuit 17. The adder circuit 17 effects a binary addition of the bit signal and the minus seven signal, which is the equivalent of dividing the count of the binary bit signal by seven, and produces a remainder signal $S_\alpha$, $S_\gamma$, $S_\beta$, $S_\alpha$ to latch S circuit 18, which circuit, in turn, applies a day of the week signal $W_\gamma$, $W_\beta$, $W_\alpha$ to day of the week decoder and display 20, to thereby automatically effect a display of the day of the week. Additionally, the outputs of the latch S circuit 18 are also applied to latch A circuit 19, which circuit stores the remainder signal from the previous division operation performed by the adder circuit 17 and permits the adder circuit 17 to sum the remainder stored in the latch A circuit 19 with the binary count of the next bit signal produced by the decoder/selector circuit 14 that is applied to the adder circuit 17 by the input selector 16.

Because the instant invention utilizes the binary count of the timekeeping signals produced by the day, month and year counters to effect a binary operation, the subscripts $\alpha$, $\beta$, $\gamma$, $\alpha$, $\epsilon$ are utilized herein to denote the respective binary outputs of the circuits.

For example, as noted above, the day of the week signals $W_\gamma$, $W_\beta$, $W_\alpha$ produced by the latch S circuit 18, and the manner in which these signals correspond to each of the seven days of the week is illustrated in Table 1 included herein.

Table 1

| Data W | | | | |
|---|---|---|---|---|
| Number | $W_\gamma$ | $W_\beta$ | $W_\alpha$ | Day |
| 0 | 0 | 0 | 0 | Sun. |
| 1 | 0 | 0 | 1 | Mon. |
| 2 | 0 | 1 | 0 | Tues. |
| 3 | 0 | 1 | 1 | Wed. |
| 4 | 1 | 0 | 0 | Thur. |
| 5 | 1 | 0 | 1 | Fir. |
| 6 | 1 | 1 | 0 | Sat. |

Accordingly, as illustrated in Table 1, the day of the week signal $W_\gamma$, $W_\beta$, $W_\alpha$ are binary representations for the numbers 0 through 6 and correspond to each of the days of the week beginning with Sunday (0, 0, 0) and ending with Saturday (1, 1, 0). Thus, the decoder and display 20, in response to receiving one of the seven binary counts illustrated in Table 1, automatically displays the day of the week corresponding to the particular count.

The manner in which the 5-bit day counter 13 produces a 5-bit timekeeping signal $D_\epsilon$, $D_\alpha$, $D_\gamma$, $D_\beta$, $D_\alpha$, which signal is selected and decoded into a first 3-bit signal $D_1$ and a second 3-bit signal $D_2$, by the decoder/selector circuit 14, is illustrated in detail in Table 2, set forth herein. As illustrated in Table 2, the day, having the numerical count of zero is the last day of the previous month. Accordingly, if the date is divisible by seven and leaves a particular remainder, the first 3-bit signal $D_1$, produced by the decoder/selector circuit, has a count equal to the number of times that seven divides into the count of the timekeeping signal, and leaves a remainder. As noted above each of the operations of the instant invention is conducted with binary digits, and therefore, division of the date by seven, when translated into binary logic, requires that the binary representation of the number minus seven be added to the binary representation of the particular date count in order to obtain the same result as if a real number were divided by seven. The 3-bit signal $D_2$ is, in every instance, equal to the binary count of the digits $D_\alpha$, $D_\beta$, $D_\gamma$. It is also noted that the first 3-bit signal $D_1$ is equal to the binary count of the last two digits $D_\epsilon$, $D_\alpha$ of the timekeeping signal produced by the day counter 13. Thereafter, calculation of the remainder of the day is obtained by summing the first 3-bit signal $D_1$ and the second 3-bit signal $D_2$ and dividing same by seven. As detailed above, the signal $D_1$ ($D_{1\gamma}$, $D_{1\beta}$, $D_{1\alpha}$) is obtained from the timekeeping signal by setting $D_{1\gamma}$ equal to 0, $D_{1\beta}$ equal to $D_{1\epsilon}$ and $D_{1\alpha}$ equal to $D_{1\alpha}$. Similarly, the 3-bit signal $D_2$ ($D_{2\gamma}$, $D_{2\beta}$, $D_{2\alpha}$) is obtained as noted above by making $D_{2\gamma}$ equal to $D_\gamma$, $D_{2\beta}$ equal to $D_\beta$ and $D_{2\alpha}$ equal to $D_\alpha$ of the timekeeping signal produced by the day counter. It is noted that the signals $D_1$ and $D_2$ cannot be said to be, strictly speaking, representations of the number of times that seven divides into the number of the date since several cases exist, specifically, seven, fourteen, twenty-one and twenty-eight, wherein seven divides evenly and would leave no remainder. In any event, as detailed above, by summing the first and second 3-bit signals $D_1$ and $D_2$ and dividing same by seven, a remainder is determined. A specific example can be taken for the twenty-ninth day, illustrated in Table 2, wherein $D_1$ equals three, $D_2$ equals five, $D_1$ plus $D_2$ equals eight, thereby leaving a remainder of one.

In order to demonstrate the manner in which the 4-bit timekeeping signals, produced by the month counter 12, are decoded and selected into third and fourth 3-bit signals $M_1$ and $M_2$, Table 3 is provided herein. It is noted that the 3-bit signal $M_1$ utilizes March or November as the standard month and the second-bit signal $M_2$ is utilized as a leap year signal. March or November are selected since both months are both thirty-one day months and both months always start on the same day of the week. Accordingly, the third and fourth 3-bit signals $M_1$ plus $M_2$ are added in the same manner as the first and second 3-bit signals and divided by seven in order to provide a remainder signal in the same manner detailed above with respect to the 3-bit signals derived from the timekeeping signals produced by the day counter. Nevertheless, the derivation of the 3-bit signals $M_1$ and $M_2$ is a bit more complex. Specifically, $M_1$ ($M_{1\gamma}$, $M_{1\beta}$, $M_{1\alpha}$) is obtained by making $M_{1\gamma}$ equal to $\overline{M}_\alpha \overline{M}_\beta M_\alpha + M_\alpha M_\alpha$, $M_{1\beta}$ equal to Table 3

| Data M | | | | | | | | | |
|---|---|---|---|---|---|---|---|---|---|
| Month | $M_\alpha$ | $M_\gamma$ | $M_\beta$ | $M_\alpha$ | $M_1$ | $M_{1\gamma}$ | $M_{1\beta}$ | $M_{1\alpha}$ | $M_2$ |
| 1 | 0 | 0 | 0 | 1 | 4 | 1 | 0 | 0 | 6 |
| 2 | 0 | 0 | 1 | 0 | 0 | 0 | 0 | 0 | 6 |
| 3 | 0 | 0 | 1 | 1 | 0 | 0 | 0 | 0 | 0 |
| 4 | 0 | 1 | 0 | 0 | 3 | 0 | 1 | 1 | 0 |
| 5 | 0 | 1 | 0 | 1 | 5 | 1 | 0 | 1 | 0 |
| 6 | 0 | 1 | 1 | 0 | 1 | 0 | 0 | 1 | 0 |
| 7 | 0 | 1 | 1 | 1 | 3 | 0 | 1 | 1 | 0 |
| 8 | 1 | 0 | 0 | 0 | 6 | 1 | 1 | 0 | 0 |
| 9 | 1 | 0 | 0 | 1 | 2 | 0 | 1 | 0 | 0 |
| 10 | 1 | 0 | 1 | 0 | 4 | 1 | 0 | 0 | 0 |
| 11 | 1 | 0 | 1 | 1 | 0 | 0 | 0 | 0 | 0 |

Table 2

| Data D | | | | | | | | | | | | | | | | | |
|---|---|---|---|---|---|---|---|---|---|---|---|---|---|---|---|---|---|
| Date | $D_\epsilon$ | $D_{60}$ | $D_\gamma$ | $D_\beta$ | $D_\alpha$ | Remainder | $D_1$ | $D_2$ | Date | $D_\epsilon$ | $D_\alpha$ | $D_\gamma$ | $D_\beta$ | $D_\alpha$ | Remainder | $D_1$ | $D_2$ |
| 0 | 0 | 0 | 0 | 0 | 0 | 0 | 0 | 0 | 16 | 1 | 0 | 0 | 0 | 0 | 2 | 2 | 0 |
| 1 | 0 | 0 | 0 | 0 | 1 | 1 | 0 | 1 | 17 | 1 | 0 | 0 | 0 | 1 | 3 | 2 | 1 |
| 2 | 0 | 0 | 0 | 1 | 0 | 2 | 0 | 2 | 18 | 1 | 0 | 0 | 1 | 0 | 4 | 2 | 2 |
| 3 | 0 | 0 | 0 | 1 | 1 | 3 | 0 | 3 | 19 | 1 | 0 | 0 | 1 | 1 | 5 | 2 | 3 |
| 4 | 0 | 0 | 1 | 0 | 0 | 4 | 0 | 4 | 20 | 1 | 0 | 1 | 0 | 0 | 6 | 2 | 4 |
| 5 | 0 | 0 | 1 | 0 | 1 | 5 | 0 | 5 | 21 | 1 | 0 | 1 | 0 | 1 | 0 | 2 | 5 |
| 6 | 0 | 0 | 1 | 1 | 0 | 6 | 0 | 6 | 22 | 1 | 0 | 1 | 1 | 0 | 1 | 2 | 6 |
| 7 | 0 | 0 | 1 | 1 | 1 | 0 | 0 | 7 | 23 | 1 | 0 | 1 | 1 | 1 | 2 | 2 | 7 |
| 8 | 0 | 1 | 0 | 0 | 0 | 1 | 1 | 0 | 24 | 1 | 1 | 0 | 0 | 0 | 3 | 3 | 0 |
| 9 | 0 | 1 | 0 | 0 | 1 | 2 | 1 | 1 | 25 | 1 | 1 | 0 | 0 | 1 | 4 | 3 | 1 |
| 10 | 0 | 1 | 0 | 1 | 0 | 3 | 1 | 2 | 26 | 1 | 1 | 0 | 1 | 0 | 5 | 3 | 2 |
| 11 | 0 | 1 | 0 | 1 | 1 | 4 | 1 | 3 | 27 | 1 | 1 | 0 | 1 | 1 | 6 | 3 | 3 |
| 12 | 0 | 1 | 1 | 0 | 0 | 5 | 1 | 4 | 28 | 1 | 1 | 1 | 0 | 0 | 0 | 3 | 4 |
| 13 | 0 | 1 | 1 | 0 | 1 | 6 | 1 | 5 | 29 | 1 | 1 | 1 | 0 | 1 | 1 | 3 | 5 |
| 14 | 0 | 1 | 1 | 1 | 0 | 0 | 1 | 6 | 30 | 1 | 1 | 1 | 1 | 0 | 2 | 3 | 6 |
| 15 | 0 | 1 | 1 | 1 | 1 | 1 | 1 | 7 | 31 | 1 | 1 | 1 | 1 | 1 | 3 | 3 | 7 |

Table 3-continued

| | Data M | | | | | | | | |
|---|---|---|---|---|---|---|---|---|---|
| Month | $M_\alpha$ | $M_\gamma$ | $M_\beta$ | $M_\alpha$ | $M_1$ | $M_{1\gamma}$ | $M_{1\beta}$ | $M_{1\alpha}$ | $M_2$ |
| 12 | 0 | 0 | 0 | 0 | 2 | 0 | 1 | 0 | 0 |

$M_\beta(M_\alpha + M_\gamma) + M_\gamma M_\beta M_\alpha$ and $M_{1\alpha}$ equal to $M_\gamma$. The signal $M_2$ ($M_{2\gamma}$, $M_{2\beta}$, $M_{2\alpha}$) is obtained by setting $M_{2\gamma}$ equal to $M_{2\beta}$, which, in turn, is set equal to l. $M_\alpha$ $M_\gamma$ ($M_\beta \cdot M_\alpha + M_\beta M_\alpha$, and $M_{2\alpha}$ is equal to 0, where l is a signal having a binary value of 1 in each leap year and 0 in the years that are not leap years.

The manner in which a fifth 3-bit signal $Y_1$, sixth 3-bit signal $Y_2$ and seventh 3-bit signal $Y_3$ are derived from the timekeeping signal ($Y_\epsilon$, $Y_\alpha$, $Y_\gamma$, $Y_\beta$) produced by the year counter 11 is illustrated in Table 4, set forth herein. However, it is noted Table 4

| | Data Y | | | | | | | | | | |
|---|---|---|---|---|---|---|---|---|---|---|---|
| Year | Y | — | $Y_1$ | $Y_2$ | $Y_3$ | Year | Y | — | $Y_1$ | $Y_2$ | $Y_3$ |
| 76 | 0 | 0 | 0 | 0 | 0 | 92 | 16 | 6 | 4 | 2 | 0 |
| 77 | 1 | 1 | 0 | 0 | 1 | 93 | 17 | 0 | 4 | 2 | 1 |
| 78 | 2 | 2 | 0 | 0 | 2 | 94 | 18 | 1 | 4 | 2 | 2 |
| 79 | 3 | 3 | 0 | 0 | 3 | 95 | 19 | 2 | 4 | 2 | 3 |
| 80 | 4 | 5 | 1 | 0 | 4 | 96 | 20 | 4 | 5 | 2 | 4 |
| 81 | 5 | 6 | 1 | 0 | 5 | 97 | 21 | 5 | 5 | 2 | 5 |
| 82 | 6 | 0 | 1 | 0 | 6 | 98 | 22 | 6 | 5 | 2 | 6 |
| 83 | 7 | 1 | 1 | 0 | 7 | 99 | 23 | 0 | 5 | 2 | 7 |
| 84 | 8 | 3 | 2 | 1 | 0 | 2000 | 24 | 2 | 6 | 3 | 0 |
| 85 | 9 | 4 | 2 | 1 | 1 | 01 | 25 | 3 | 6 | 3 | 1 |
| 86 | 10 | 5 | 2 | 1 | 2 | 02 | 26 | 4 | 6 | 3 | 2 |
| 87 | 11 | 6 | 2 | 1 | 3 | 03 | 27 | 5 | 6 | 3 | 3 |
| 88 | 12 | 1 | 3 | 1 | 4 | 04 | 28 | 0 | 7 | 3 | 4 |
| 89 | 13 | 2 | 3 | 1 | 5 | 05 | 29 | 1 | 7 | 3 | 5 |
| 90 | 14 | 3 | 3 | 1 | 6 | 06 | 30 | 2 | 7 | 3 | 6 |
| 91 | 15 | 4 | 3 | 1 | 7 | 07 | 31 | 3 | 7 | 3 | 7 |

that the binary coded representation of the 5-bit timekeeping signal, produced by the year counter 11, is identical to the binary coded representation of the 5-bit timekeeping signal produced by the day counter 13 and, hence, has been omitted from Table 4 for the sake of simplifying the presentation of same herein. It is noted that the sixth 3-bit signal $Y_2$ and the seventh 3-bit signal $Y_3$ are derived in the identical manner utilized to derive the first and second 3-bit signals $D_1$ and $D_2$. Additionally, the fifth 3-bit signal $Y_1$ is obtained by making $Y_1$ equal to the last three bits of the timekeeping signal in a manner to be demonstrated in greater detail below. The dividing of a 365 day year by seven provides a remainder of one and the dividing of a 366 day year, during a leap year, by seven provides a remainder of two. Accordingly, the fifth, sixth and seventh 3-bit signals are derived by utilizing the month of March or November of 1976 as a reference standard. The deviation, illustrated in Table 4, is obtained by dividing the sum of the fifth, sixth and seventh 3-bit signals by seven. Specifically, the fifth 3-bit signal $Y_1$ ($Y_{1\gamma}$, $Y_{1\beta}$, $Y_{1\alpha}$) is obtained by making $Y_{1\gamma}$ equal to $Y_\epsilon$, $Y_{1\beta}$ equal to $Y_\alpha$ and $Y_{1\alpha}$ equal to $Y_\gamma$. In every other respect the sixth and seventh 3-bit signal $Y_2$ ($Y_{2\gamma}$, $Y_{2\beta}$, $Y_{2\alpha}$) and $Y_3$ ($Y_{3\gamma}$, $Y_{3\beta}$, $Y_{3\alpha}$) are obtained in the identical manner that the first and second 3-bit signals $D_1$ and $D_2$ are derived. Accordingly, in the year 2001, $Y_1$ plus $Y_2$ plus $Y_3$ equals six plus three plus one equals ten and the remainder, obtained by dividng ten by seven, is three, which number represents the deviation.

As detailed above, the zero day of March or November, otherwise recognized as the last day of February or October of 1976, is a Sunday and this day it utilized as a reference standard for the day of the week electronic circuitry. Accordingly, the remainder obtained by summing the seven 3-bit signal, $D_1$ plus $D_2$ plus $M_1$ plus $M_2$ plus $Y_1$ plus $Y_2$ plus $Y_3$ by seven, will produce a remainder signal, which remainder signal is representative of the day of the week. In the circuit illustrated in FIG. 1, the respective 3-bit signals are successively applied to the 4-bit adder circuit 17, and after each 3-bit signal is applied, the input selector 16 applies the minus seven binary signal stored in the read only memory 15 the necessary number of times to effect a division of the real number stored in the adder circuit by seven. In actual operation, once the first 3-bit signal $D_1$ is divided by seven, the remainder, if any, produced thereby will be stored in the latch A circuit 17 and will be applied to the adder 17 to be summed with the next 3-bit digit signal $D_2$ when same is applied to the adder 17 by the input selector 16. Thereafter, the sum of the remainder stored in latch A circuit 17 and the second 3-bit signal $D_2$ are divided by seven by applying the minus seven binary code (1 0 0 1) to the adder 17 to thereby establish a new remainder, which remainder is again applied to the latch S circuit 18 and, based thereon, is also stored in the latch A circuit 19 for summing with the next 3-bit signal applied to the adder circuit 17. Accordingly, each of the seven 3-bit signals are seriatim applied to the adder 17 by the input selector 16 until the output signal $S_\alpha$, $S_\beta$, $S_\gamma$, $S_\alpha$ stored in the latch S circuit 18 is a signal representative of all seven of the bit signals having been summed and divided by seven. The remainder produced by the adder, in response to the seventh 3-bit signal being summed therein and divided by seven, represents the remainder signal $W_\gamma$, $W_\beta$, $W_\alpha$, the binary representation of the remainder signal representing the day of the week. Accordingly, the remainder signal is applied to the day of the week decoder and display in order to automatically effect a display of the day of the week. As detailed above, the minus seven binary count ($C_\alpha$, $C_\gamma$, $C_\beta$, $C_\alpha$) applied to the adder by the input selector 16 can be obtained by making $C_\alpha$ equal to $C_\alpha$ equal to $A_\alpha + A_\gamma A_\beta A_\alpha$ and $C_\gamma$ equal to $C_\beta$ equal to zero.

Referring to FIG. 2, a timing diagram, illustrating the operation of the day of the week circuitry described above, is depicted. The calculation of the day of the week is performed when timing pulse 30 is in a positive half cycle. The positive half cycle of the signal 30 can be selected to be performed at a predetermined time in the timepiece, such as once each hour or once each day. Moreover, the duration of the timing signal can be limited to one-thirty-second of a second or any larger time interval. The timing representation 31, illustrated in FIG. 2, demonstrates the eight distinct periods of operation of the input selector 16. Specifically, during the time interval $t_1$, each of the respective circuits for automatically producing a day of the week signal are reset. Thereafter, during the time intervals $t_2$ through $t_8$, the respective 3-bit signals, starting with the seventh timing signal $Y_1$ in the interval $t_2$ and finishing with the last 3-bit timing signal $D_1$ during the time interval $t_8$, are seriatim applied to the adder 17. Selection of the 3-bit signals by the decoder/selector circuit is effected by utilizing three distinct frequency signals and switching circuitry of the type well known in the art. An input selector timing pulse 32 is applied to the input selector 16 and selects the 3-bit signals produced by the decoder/selector signals to be applied to the adder 17. When the input selector timing signal 32 is in a positive half cycle, a 3-bit signal produced by the decoder/selector circuit 14 is applied to the adder 17. Alternatively, when the input selector timing signal 32 is in a negative half cycle, the input selector 16 applies the minus seven binary representation stored in the read only memory 15 to the adder 17. A latch S circuit write-in pulse signal 33 is utilized to write-in the output $S_\alpha$, $S_\gamma$, $S_\beta$, $S_\alpha$ of the adder 17 when the write-in pulse is a positive going pulse. Similarly, write-in pulse 34 is utilized to write-in to the latch A circuit 19 the binary pulse stored in the latch S circuit 18. By delaying the write-in pulse 34 of the latch A circuit 19 with respect to the write-in pulse 33 of the latch S circuit 18, the latch A circuit 19 is assured of receiving the last remainder stored in the latch S circuit 18 prior to the next interval during which the next 3-bit signal is applied to the adder 17.

Accordingly, the instant invention is particularly characterized by circuitry that permits the day of the week to be automatically displayed with the entire calculation being reliably effected in as little as one-thirty-second of a second. Moreover, although the circuitry, described in detail herein, and the manner in which same effects summing of the bit signals can take other forms, the division by seven to obtain the remainder signal is required in order to obtain a day of the week remainder signal that assures a proper display of such information. A further and considerable benefit of the instant invention is that it permits a person wearing an electronic wristwatch having such day of the week selection circuitry to set the day, month and year calendar display either forward or backward to a particular date and thereby ascertain what day of the week that date occurred on.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece including day counter means, month counter means and year counter means, each of said counter means being adapted to produce timekeeping signals representative of a binary count thereof, the improvement comprising day of the week means adapted to receive said timekeeping signals produced by said day counter means, month counter means and year counter means, said day of the week means being adapted to sum said timekeeping signals produced by said respective counter means and divide the summed signals by seven to thereby produce a remainder signal representative of the day of the week, and day of the week decoder and display means for decoding the day of the week signal and in response thereto effecting a display of the day of the week.

2. In an electronic timepiece including day counter means, month counter means and year counter means, each of said counter means being adapted to produce timekeeping signals representative of a binary count thereof, the improvement comprising decoder and selection means coupled to each of said counter means for receiving the timekeeping signals produced thereby, decoding said timekeeping signals received thereby and seriatim producing a plurality of binary bit signals each of which are representative of a binary count of said selected and decoded timekeeping signals, remainder means for receiving each of said binary bit signals, summing the binary bit signals and dividing the summed binary bit signals by seven, said remainder means being adapted to produce a remainder signal representative of the day of the week, and day of the week decoder and display means for decoding and displaying the day of the week in response to the remainder signal being applied thereto.

3. An electronic timepiece as claimed in claim 2, wherein said remainder means includes an adder means for effecting a summing operation, a memory means for storing a minus seven binary count signal and an input selection means, said input selection means being disposed intermediate said adder means and said memory means and decoding and selection means for applying said bit signals seriatim produced by said decoder and selection means to said adder means, said input selection means being further adapted after each bit signal is applied to said adder means to apply said minus seven binary signal to said adder means to thereby produce said remainder signal after each of said seriatim bit signals and minus seven binary signals have been applied to said adder means.

4. An electronic timepiece as claimed in claim 3, and including an output latch circuit disposed intermediate said adder means and decoder and display means for storing said remainder signal produced by said adder means and applying same to said decoder and display means to effect a continuous display of said day of the week thereby.

5. An electronic timepiece as claimed in claim 4, wherein a second latch circuit is disposed intermediate said first latch circuit and said adder means for receiving the remainder signal stored by said first latch circuit and applying same to said adder means each time that one of said binary bit signals is applied to said adder means to be summed therewith.

6. An electronic timepiece as claimed in claim 2, wherein said day counter means and said year counter means are adapted to produce 5-bit timekeeping signals, said month counter means being adapted to produce a 4-bit timekeeping signal, said decoding and selection means being adapted to seriatim produce seven distinct 3-bit signals in response to said timekeeping signals produced by said day counter means, month counter means and year counter means being applied thereto.

7. An electronic timepiece as claimed in claim 6, wherein a first 3-bit signal $D_1$ ($D_{1\gamma}$, $D_{1\beta}$, $D_{1\alpha}$) is produced by said decoding and selection means in response to said 5-bit day timekeeping signal having binary components $D_\epsilon$, $D_\alpha$, $D_\gamma$, $D_\beta$, $D_\alpha$ applied thereto is derived by setting $D_1$ equal to zero, $D_{1\beta}$ equal to $D_\epsilon$ and $D_{1\alpha}$ equal to $D_\alpha$, and a second 3-bit signal $D_2$ ($D_{2\gamma}$, $D_{2\beta}$, $D_{2\alpha}$) produced by said decoding and selection means in response to said 5-bit day timekeeping signal being applied thereto is obtained by setting $D_{2\gamma}$ equal to $D_{\gamma, D2\beta}$ equal to $D_\beta$ and $D_{2\alpha}$ equal to $D_\alpha$.

8. An electronic timepiece as claimed in claim 6, wherein a third 3-bit signal $M_1$ ($M_{1\gamma}$, $M_{1\beta}$, $M_{1\alpha}$) is produced by said decoding and selection means in response to said timekeeping signals having binary components $M_\alpha$, $M_\gamma$, $M_\beta$, $M_\alpha$ produced by said month counter means by setting $M_{1\gamma}$ equal to $\overline{M}_\alpha\overline{M}_\beta M_\alpha + M_\gamma \cdot \overline{M}_\alpha$, $M_{1\beta}$ equal to $\overline{M}_\beta(\overline{M}_\alpha + M_\gamma) + M_\gamma \cdot M_\beta \cdot M_\alpha$ and $M_{1\alpha}$ equal to $M_\gamma$, and said fourth 3-bit signal $M_2$ ($M_{2\gamma}$, $M_{2\beta}$, $M_{2\alpha}$) is produced in response to said timekeeping signals produced by said month counter means and is obtained by setting $M_{2\gamma}$ equal to $M_{2\beta}$ equal to $l \cdot \overline{M}_\alpha \overline{M}_\gamma$ ($\overline{M}_\beta M_\alpha + M_\beta \overline{M}_\alpha$) and $M_{2\alpha}$ equal to zero, where l is a binary signal having a value one during each leap year and zero in other than leap years.

9. An electronic timepiece as claimed in claim 6, wherein a fifth 3-bit signal $Y_1$ ($Y_{1\gamma}$, $Y_{1\beta}$, $Y_{1\alpha}$) is produced said selection and decoding means in response to said timekeeping signals having binary components $Y_\epsilon$, $Y_\alpha$, $Y_\gamma$, $Y_\beta$, $Y_\alpha$ produced by said year counter means and is obtained by setting $Y_{1\gamma}$ equal to $Y_\epsilon$, $Y_{1\beta}$ equal to $Y_\alpha$ and $Y_\alpha$ equal to $Y_\gamma$, said sixth 3-bit signal $Y_2$ ($Y_{2\gamma}$, $Y_{2\beta}$, $Y_{2\alpha}$) is produced in response to timekeeping signals produced by said year counter means being applied thereto by setting $Y_{2\gamma}$ equal to zero, $Y_{2\beta}$ equal to $Y_\epsilon$ and $Y_{2\alpha}$ equal to $Y_\gamma$, and said seventh 3-bit signal $Y_3$ ($Y_{3\gamma}$, $Y_{3\beta}$, $Y_{3\alpha}$) is produced by said decoding and selection means in response to the timekeeping signals produced by said year counter means by setting $Y_{3\gamma}$ equal to $Y_\gamma$, $Y_{3\beta}$ equal to $Y_\beta$ and $Y_{3\alpha}$ equal to $Y_\alpha$.

* * * * *